United States Patent [19]

Stuhlman

[11] 4,161,302

[45] Jul. 17, 1979

[54] RETAINING STRUCTURE FOR GUTTER DOWNSPOUTS

[76] Inventor: Frank A. Stuhlman, Rte. 3, Weller Dr., Plainfield, Ill. 60544

[21] Appl. No.: 825,221

[22] Filed: Aug. 17, 1977

[51] Int. Cl.[2] ..... B05B 15/06; E04D 13/08

[52] U.S. Cl. ..... 248/49; 239/275; 239/276; 248/87; 248/156

[58] Field of Search ..... 248/49, 80, 85–88, 248/75, 71, 48.2, 156, 175, 176, 187; 239/275, 276; 52/16; 61/14, 15

[56] References Cited

U.S. PATENT DOCUMENTS

| | | | |
|---|---|---|---|
| 1,366,710 | 1/1921 | Anker | 248/156 |
| 1,467,082 | 9/1923 | Baldwin | 248/175 X |
| 2,176,352 | 10/1939 | McHuron | 248/156 X |
| 2,331,421 | 10/1943 | Redhead | 248/87 X |
| 2,455,278 | 11/1948 | Stewart et al. | 248/176 X |
| 2,862,764 | 12/1958 | Frese | 239/276 X |
| 3,021,102 | 2/1962 | Kuempel | 248/49 |
| 3,809,348 | 5/1974 | DiLaura | 248/87 X |

*Primary Examiner*—Rodney H. Bonck

*Attorney, Agent, or Firm*—Hill, Van Santen, Steadman, Chiara & Simpson

[57] ABSTRACT

A retaining structure for gutter downspouts, particularly a laterally extending downspout, comprising an elongated ground-engaging supporting member which carries at its upper end a laterally extending downspout-receiving member having means for restricting lateral movement of a downspout and a retaining member which is provided with means for restricting both upward and longitudinal movement of a supported downspout.

6 Claims, 5 Drawing Figures

RETAINING STRUCTURE FOR GUTTER DOWNSPOUTS

BACKGROUND OF THE INVENTION

The invention relates to a retaining structure for gutter downspouts, particularly a laterally extending downspout adapted to carry water from the vertical downspout of a gutter structure to a point relatively remote from the associated building.

Gutter downspouts oftentimes are connected at their lower ends with a more or less horizontally or sloping section by means of which the water transported by the downspout may be conducted to a point relatively remote from the lower end of the vertical section of the downspout and from the adjacent building and its foundation. In most instances, such lateral downspout is connected to the vertical downspout by a standard elbow, the free end of which is adapted to nest into the corresponding end of the lateral downspout. In some instances screws or other means may be employed to connect the elbow and lateral downspout, but in many cases the latter is merely connected to the elbow by a press fit with the free end of the lateral downspout resting on the ground or other surface.

As a result, it is relatively easy for the downspout to eventually work off of the elbow permitting the disconnection therebetween and in the event of a storm, permitting the vertical downspout to discharge its load substantially directly at the base of the building.

While devices are known for supporting downspouts and similar tubular pipes or members, these usually take the form of a trestle-shaped structure merely forming a cradle for the tubular member. An example of this type of structure is illustrated in U.S. Pat. No. 3,021,102. Similar types of structures for flexible hose and conduits are illustrated in U.S. Pat. Nos. 3,819,137, 3,809,348, 3,554,474 and 3,572,622.

BRIEF SUMMARY OF THE INVENTION

This invention is directed to the production of a gutter downspout retaining structure which may be readily inserted in the ground, and which will effectively support the free end of such a downspout in a desired location and position, restricting not only lateral and upward movement of the downspout end, but also longitudinal or axial movement, thereby effectively retaining the downspout in engagement with the supporting structure as well as in engagement with a cooperable elbow or the like, without the use of attaching screws, etc.

Consequently, the lateral downspout may be readily and quickly detached when desired, for example, when cutting grass underneath the downspout and subsequently readily reassembled.

These results are achieved by a simple structure having three main components, the first a ground engaging member adapted to be at least partially inserted into the ground in a more or less vertical position, and thereby support the remaining structure therefrom. The second is a downspout-receiving member carried at the upper end of the supporting member at substantially right angles thereto to form therewith a generally T-shaped structure. The outer ends of the downspout-receiving member provided with upstanding portions adapted to be disposed adjacent the sidewalls of a downspout resting on the members to restrict lateral movement of the downspout relative thereto. The third is a retaining member which extends from the intersection of the first two members, at substantially right angles relative to both members and thus, with the second member, forms a structure of T-shaped configuration lying in a plane extending substantially at right angles to the supporting member. The free end of the retaining member terminates in an upwardly and rearwardly extending portion adapted to enter the open end of a supported downspout, thus preventing both upward and longitudinal movement of the free end of the downspout, to normally prevent disengagement of the latter from the device, and also prevent disengagement of the opposite end of the downspout from a connecting elbow or the like. The respective members may be fabricated from suitable stock, for example, rectangular bar or strip stock, or round rod, or wire stock, with the respective members being suitably secured in assembled relation. In a further advantageous form of the invention, the first and third members may be integrally constructed from a single piece of stock suitably formed to provide both members and the second downspout receiving member formed from a further piece of stock and suitably secured in assembled relation. In a further advantageous embodiment of the invention, the structure may be formed from a single piece of stock, for example, rod or wire stock suitably bent to provide the respective members.

BRIEF DESCRIPTION OF THE DRAWINGS

In the drawing wherein like reference characters indicate like or corresponding parts.

DETAILED DESCRIPTION OF THE INVENTION

Figure 1:
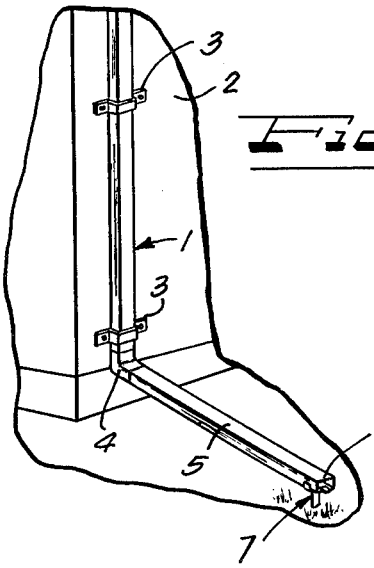
FIG. 1 is a perspective view of a portion of a building or the like illustrating a vertical and lateral downspout associated therewith.

It is customary, as illustrated in FIG. 1, to employ vertical downspout sections, such as that indicated by the reference numeral 1, to carry water from roof gutters to the ground. Such downspouts usually are secured to the building, as for example the wall 2, by suitable strap brackets 3 or the like, with the lower end of the gutter disposed adjacent the ground. In many cases, the lower end of the gutter is provided with an elbow fitting 4 to which is connected a lateral downspout member 5, whereby water passing through the downspout 1 will be conducted to a point relatively remote from the building wall and foundation, rather than discharged adjacent the structure. As generally illustrated in FIG. 1, the free end 6 of the lateral downspout 5 is adapted, in accordance with the invention, to be carried by a supporting structure, indicated generally by the reference numeral 7, with the structure 7 being adapted to be at least partially inserted into the ground and to receive and support the end 6 of the downspout to support the same in a desired position for discharge of water therefrom.

Figure 2:
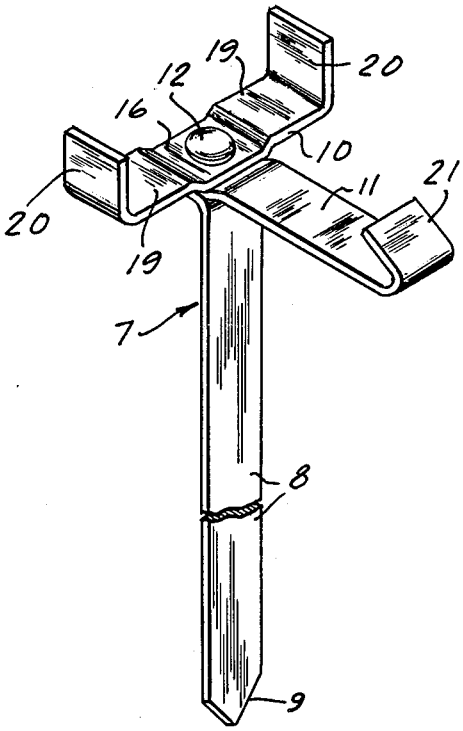
FIG. 2 is a perspective view of one embodiment of the present invention.

As illustrated in FIG. 2, the support structure 7, in the embodiment illustrated, is constructed from strip or bar stock of suitable material, as for example a strip having adequate inherent rigidity for the desired purpose and preferably of a material which will adequately withstand the elements. Aluminum is widely employed in the fabrication of gutters as it is non-rusting, and expediently the supporting structure of the present invention likewise may be constructed from aluminum stock.

Figure 3:
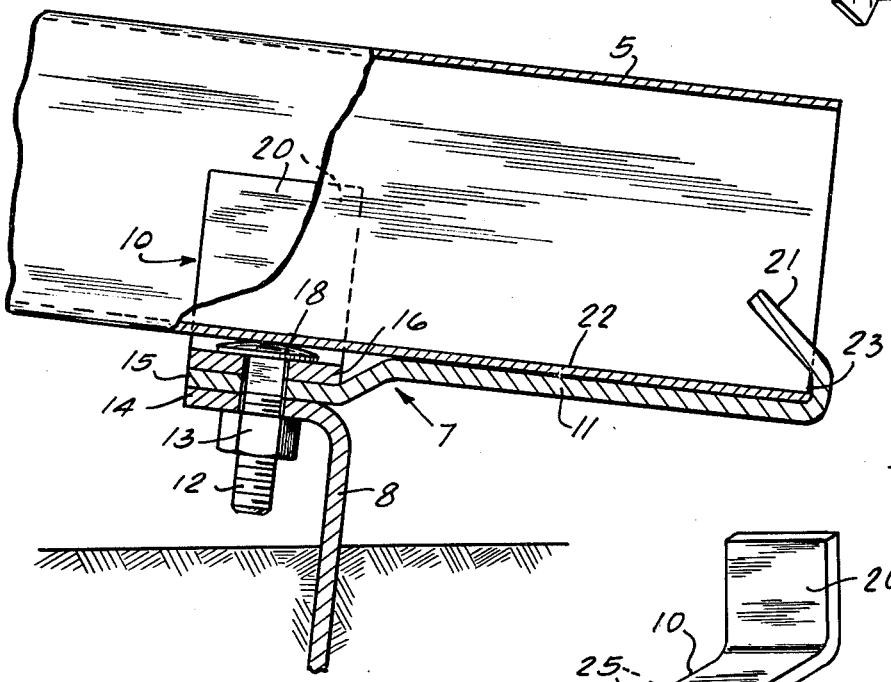
FIG. 3 illustrates a sectional view of the structure illustrated in FIG. 2 illustrating its association, in use, with a gutter downspout.

In the embodiment illustrated in FIG. 2 the supporting structure is fabricated in the form of three individual members or strips, a generally vertically disposed ground engaging member 8, having a pointed lower end 9 to facilitate insertion into the earth, a laterally extending member 10 and a forwardly extending member 11, with the three members being secured together by suitable means, such as a carriage bolt 12 and nut 13, rivet means, spot welding, or the like. As illustrated in FIGS. 2 and 3, the upper end of the member 8 is bent substantially at right angles to the main portion thereof to form a generally horizontally extending flange 14, with the member 11 having its adjacent end 15 supported on the flange 14. The member 10 is provided with a central portion 16 which is supported on the upper face of the adjacent end portion 15 of the member 11, with the bolt 12 passing through the superimposed portions of the respective members, whereby such portions will be rigidly clamped between the head 18 of the bolt and the nut 13.

The member 10 is provided with aligned laterally extending portions 19 which terminate at their free ends in upwardly extending portions 20, while the member 11 is provided at its opposite free end with an upwardly and rearwardly extending end portion 21.

As clearly illustrated in FIGS. 2 and 3 the end portion 15 of the member 11 is offset downwardly as viewed in FIG. 3, with respect to the opposite end portion thereof a distance equal approximately to the combined thickness of the member 10 and the head 18 of the bolt 12. In like manner the central portion 16 of the member 10 is downwardly offset with respect to the lateral portions 19 a distance equal approximately the thickness of the head 18 of the bolt 12. The proportions thus are such that the portions 19 of the member 10 and the main portion of the member 11 are disposed in a common plane which extends at substantially right angles to the plane of the member 8, with the head 18 of the bolt 12 being disposed below such plane, whereby the bottom wall 22 of the lateral downspout 5 may be supported on the portions 19 of the member 10 and the main portion of the member 11, as clearly illustrated in FIG. 3, without interference from the head 18 of the bolt 12.

The upwardly extending portions or flanges 20 of the member 10 are preferably spaced apart a distance approximately equal to the corresponding width of the downspout to be supported by the structure, whereby lateral movement of the downspout relative to the supporting structure will be prevented.

As will be apparent from a reference of FIG. 3, the adjacent end edge 23 of the bottom wall 22 of the downspout 5 is adapted to engage the member 11 at the more or less hooked shaped end formed at the juncture of the upwardly and rearwardly extending end 21 thereof with the remainder of the member 11, with the free end 21 extending into the open end of the downspout. The free end of the downspout thus is hooked or interlocked with the supporting structure 7, preventing the free end of the downspout from merely being lifted out of engagement with the member 10 and the upstanding portions 20 carried thereby, thus preventing undesired disengagement of the downspout therefrom.

In use, following the connection of the lateral downspout 5 to the elbow 4, the final location of the free end of the downspout 5 is determined and the vertical member 8 of the supporting structure is inserted, at the desired location, into the earth to a suitable depth to provide the desired positioning of the free end of the downspout. The supporting structure then may be sprung forwardly toward the free end 21 of the member 11 a sufficient distance to permit the free end edge 23 of the downspout to be moved downwardly past the end 21 to the position illustrated in FIG. 3. In most cases, the earth will have sufficient give, as well as the downspout elbow, to readily permit such engagement.

It will be appreciated that the downspout 5, when so supported, is not only laterally restricted by the portions 20 of the member 10 but is further prevented by the free end 21 from being lifted out of engagement with the member 10 and the portions 20. At the same time, the free end configuration of the member 11 prevents longitudinal or axial movement of the downspout 5 in a direction away from the elbow 4 and thus prevents an accidental disconnection of the downspout 5 from the elbow 4, even though the two may not be secured together by screws or other connecting means. Consequently, the provision of such securing means will usually be rendered unnecessary, whereby the downspout 5 may be readily disconnected from the supporting structure 7 and then from the elbow 4, when desired. This is of particular advantage in connection with the use of relatively long downspouts, for example a full 10 foot downspout section, as such section may extend over lawn which must be periodically moved. Consequently, with the invention, the downspout section may be readily disconnected and removed with the supporting structure 7 preferably being temporarily pulled out of the ground to enable free mowing of the ground underneath the downspout. When the mowing operation is completed, the supporting structure 7 may be readily reinserted into the earth, the downspout 5 reconnected to the elbow 4 and engaged with the supporting structure 7. As the height of the supporting structure may be varied with respect to the ground, the elevation of the free end of the downspout with respect to the ground and the elbow 4 may be readily adjusted as may be desired or required.

Figure 4:
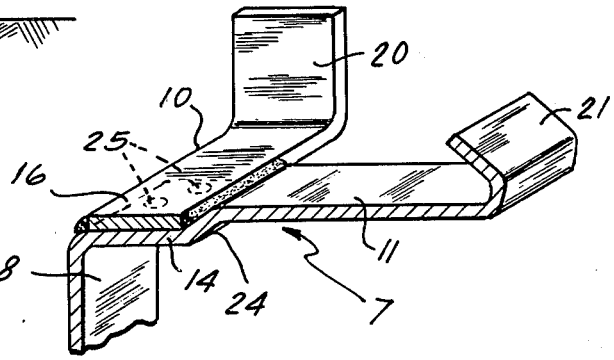
FIG. 4 is a perspective view of a modified form of the invention with portion of the same in section, generally corresponding to the section of FIG. 3.

FIG. 4 illustrates a modified form of construction of the supporting structure 7 in which the supporting member 8 and the retaining member 11 are formed from a single piece of bar or strip stock, with the portion 14 extending forwardly in the same direction as the member 11 and integrally connected thereto by the offset 24, which corresponds to the similar offset in the member 11. In this construction, the member 10 is not provided with an offset central portion 16, the portions 16 and 19 being disposed in a common plane with the portion 16 being secured to the portion 14 by suitable spot welding 25 or the like. The member 11 thus is disposed in the same plane as the portions 16–19 of the member 10. Installation and use of this construction would be the same as that previously described.

Figure 5:
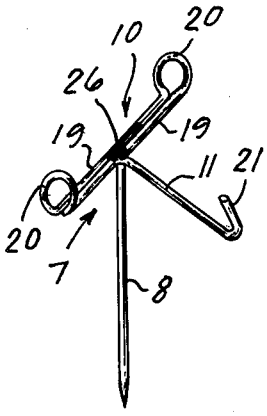
FIG. 5 is a perspective view of a further embodiment of the invention utilizing wire or rod stock.

FIG. 5 illustrates a supporting structure, in accordance with the present invention, fabricated from a single piece of material suitably formed to provide the respective supporting, receiving and retaining members. In the construction illustrated, the structure is formed from wire or rod stock having sufficient rigidity for the desired purposes but capable of being bent or formed to the desired configuration. Thus, the supporting member 8 may comprise one end portion of the stock and provided at its upper end with a lateral bent to form a portion of the member 10. The stock is then formed with a loop or eye 20, which corresponds to the upwardly extending portions 20 of the structure illustrated in FIG. 2, with the stock then extending laterally back to the member 8 and continuing outwardly to form the other portion 19 of the member 10. A similar loop or eye 20 is then formed at the free end of such portion 19, with the stock then extending back to the supporting member 8, at which it is provided with a further bend whereby the other free end of the stock forms the member 11 and terminates in the reversally bent free end portion 21. If necessary or desirable, the juncture of the members 8, 10 and 11 may be secured together by suitable means as for example by welding or the like, a wrapping of the stock, or a suitable retaining member may be connected therewith.

The construction illustrated in FIG. 5 is installed and used in the same manner as previously described before the other constructions, and offers all of the advantages of the same.

It will be apparent from the above description that all three embodiments of the invention provide a supporting member, a downspout-receiving member which is provided with means at its free ends for preventing lateral movement of the downspout, and a retaining member which is provided with means for engaging the free-end of the downspout to prevent undesired disengagement of the downspout from the supporting structure and also from a connecting elbow at the opposite end of the downspout.

It will also be noted that as the upturned end portion 21 of the respective structures, particularly those formed from bar or strip stock, extends into the free end of the downspout, it also may function as a deflector, tending to fan out the water discharged therefrom, thus preventing a concentrated discharge that might otherwise tend to wash out a hole or channel in the ground.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. A supporting structure for a laterally extending terminal portion of a gutter downspout, comprising an elongated supporting member adapted to be disposed in the ground and extend upwardly therefrom, said supporting member having its upper end terminating in a transversely extending flange, a downspout-receiving member having an intermediate portion thereof disposed at said flange and extending at substantially right angles to the supporting member to form a generally T-shaped structure, the free ends of said downspout-receiving member having upwardly extending portions spaced apart a sufficient distance to receive a downspout therebetween with said free ends disposed adjacent to the side walls of such a downspout for restricting lateral movement of the latter relative to said supporting member, and an elongated retaining member extending in the general plane of said downspout-receiving member at approximately right angles to the latter, adapted to be disposed adjacent the bottom wall of such a downspout, said supporting, receiving and retaining members comprising individual members formed from flat strip stock, said retaining member having one end thereof disposed adjacent said T-shaped structure at the juncture of said supporting and downspout-receiving members, said flange, the intermediate portion of said downspout-receiving member, and the adjacent end of said retaining member being disposed one upon the other and secured together thereat to form a unitary structure, the opposite free end of said retaining member extending upwardly and rearwardly, whereby the end edge of the bottom wall of such a downspout may be disposed between said free end and the adjacent intermediate portion of said retaining member for restricting upward movement of such a downspout relative to the supporting structure and restricting axial movement of the downspout in a forward direction toward such free end of said retaining member.

2. A supporting structure according to claim 1, wherein said members are secured together by locking means extending through the respective members at their intersection.

3. A supporting structure for a laterally extending terminal portion of a gutter downspout, comprising an elongated supporting member adapted to be disposed in the ground and extend upwardly therefrom, said supporting member carrying at its upper end a downspout-receiving member extending at substantially right angles to the supporting member to form a generally T-shaped structure, the free ends of said downspout-receiving member having upwardly extending portions spaced apart a sufficient distance to receive a downspout therebetween with said free ends disposed adjacent to the side walls of such a downspout for restricting lateral movement of the latter relative to said supporting member, and an elongated retaining member extending in the general plane of said downspout-receiving member at approximately right angles to the latter, adapted to be disposed adjacent the bottom wall of such a downspout, said retaining member being secured, adjacent one end thereof, to said T-shaped structure at the juncture of said supporting and downspout-receiving members, said members being formed from a single piece of stock bent to form the respective members, the opposite free end of said retaining member extending upwardly and rearwardly, whereby the end edge of the bottom wall of such a downspout may be disposed between said free end and the adjacent intermediate portion of said retaining member for restricting upward movement of such a downspout relative to the supporting structure and restricting axial movement of the downspout in a forward direction toward such free end of said retaining member.

4. A supporting structure according to claim 3, wherein said supporting structure is formed from wire-like stock having a free end forming said supporting member, and bent at its upper end to extend laterally to form one end of said downspout-receiving member, the latter being provided at such end with an upwardly extending reversely bent portion, and then extending laterally back to form the other end of said downspout-receiving member, the latter provided at such last-mentioned end with an upwardly extending reversely bent portion, then extending laterally back to the supporting member, and then bent transversely to both said supporting and clamping-receiving members to form the retaining member, the latter being bent at its free end to form said upwardly and rearwardly extending portion.

5. A supporting structure for supporting the free end of a laterally extending terminal portion of a gutter downspout, comprising an elongated supporting member having a free end formed to facilitate insertion into the ground for supporting said structure therefrom, with said supporting member extending upwardly, said supporting member carrying at its upper end a generally straight downspout-receiving member extending at substantially right angles to the supporting member to form a generally T-shaped structure, the free ends of said downspout-receiving member having upwardly extending portions spaced apart a sufficient distance to receive an intermediate portion of a downspout therebetween with said free ends disposed adjacent to the side walls of such a downspout for restricting lateral movement of the latter relative to said supporting member without restriction of axial movement therebetween of said intermediate portion of such a downspout, and an elongated retaining member extending in the general plane of said downspout-receiving member at approximately right angles to the latter, adapted to be disposed adjacent the bottom wall of such a downspout, said retaining member being secured, adjacent one end thereof, to said T-shaped structure at the juncture of said supporting and downspout-receiving members, the opposite free end of said retaining member extending upwardly and rearwardly, whereby the end edge of the bottom wall of such a downspout may be disposed between said free end and the adjacent intermediate portion of said retaining member for restricting upward movement of such a downspout relative to the supporting structure and restricting axial movement of the downspout in a forward direction toward such free end of said retaining member, but permitting relative movement between said full end of the retaining member and said end edge of such a downspout in axial direction relative to the latter to facilitate disengagement therebetween.

6. A supporting structure for a laterally extending terminal portion of a gutter downspout, comprising an elongated supporting member adapted to be disposed in the ground and extend upwardly therefrom, said supporting member carrying at its upper end a downspout-receiving member extending at substantially right angles to the supporting member to form a generally T-shaped structure, the free ends of said downspout-receiving member having upwardly extending portions spaced apart a sufficient distance to receive a downspout therebetween with said free ends disposed adjacent to the side walls of such a downspout for restricting lateral movement of the latter relative to said supporting member, and an elongated retaining member extending in the general plane of said downspout-receiving member at approximately right angles to the latter, adapted to be disposed adjacent the bottom wall of such a downspout, said retaining member being secured, adjacent one end thereof, to said T-shaped structure at the juncture of said supporting and downspout-receiving members, said supporting and retaining members being formed from a single piece of stock bent, intermediate its ends at substantially right angle to form such members, the downspout-receiving member being formed from another piece of stock and secured intermediate its ends to said first piece, adjacent the bend therein, the opposite free end of said retaining member extending upwardly and rearwardly, whereby the end edge of the bottom wall of such a downspout may be disposed between said free end and the adjacent intermediate portion of said retaining member for restricting upward movement of such a downspout relative to the supporting structure and restricting axial movement of the downspout in a forward direction toward such free end of said retaining member.

* * * * *